US006716043B2

(12) United States Patent
Ishizuka

(10) Patent No.: US 6,716,043 B2
(45) Date of Patent: Apr. 6, 2004

(54) SPRING CONNECTOR WITH SLOTTED CONDUCTIVE PIN

(75) Inventor: Shinichi Ishizuka, Tokyo (JP)

(73) Assignee: Yokowo Co., Ltd., Tokyo (JP)

( * ) Notice: Subject to any disclaimer, the term of this patent is extended or adjusted under 35 U.S.C. 154(b) by 14 days.

(21) Appl. No.: 10/132,148

(22) Filed: Apr. 26, 2002

(65) Prior Publication Data

US 2002/0160637 A1 Oct. 31, 2002

(30) Foreign Application Priority Data

Apr. 27, 2001 (JP) ..... P.2001-131790
Dec. 28, 2001 (JP) ..... P.2001-400631

(51) Int. Cl.[7] ..... H01R 13/24

(52) U.S. Cl. ..... 439/131; 439/700; 439/482; 439/824

(58) Field of Search ..... 439/131, 482, 439/700, 824

(56) References Cited

U.S. PATENT DOCUMENTS 4,904,213 A * 2/1990 Hock et al. ..... 439/824
6,140,830 A * 10/2000 Ott ..... 324/761
6,159,056 A * 12/2000 Boyle ..... 439/700
6,464,511 B1 * 10/2002 Watanabe et al. ..... 439/66
2002/0123271 A1 * 9/2002 Henry et al. ..... 439/700

* cited by examiner

*Primary Examiner*—Michael C. Zarroli
(74) *Attorney, Agent, or Firm*—Morgan, Lewis & Bockius LLP

(57) ABSTRACT

An insulating holder has a first face and a second face, with a first hole that has a first diameter at the first face, and a second hole that has a second diameter larger than the first diameter and extended from the second face so as to communicate with the first hole. Inside the second hole is a plate-shaped conductive terminal that has a base portion and at least one pair of guide portions extended from the base portion so as to define a concave portion between opposed inner edges of the guide portions. The concave portion faces the first hole. Included in between the opposed inner edges of the guide portions is a conductive pin with a plunger portion that has a diameter smaller than the first diameter and a bulged portion that has a diameter larger than the first diameter. The bulged portion of the pin has opposed grooves at its periphery that run parallel to the plunger portion's longitudinal axis and is fitted with the guide portions so as to be slidable along the concave portion. A spring member is also provided in the concave portion so as to urge the pin toward the first face of the holder, so that the plunger portion of the pin is retractably protruded from the first face of the holder through the first hole.

8 Claims, 7 Drawing Sheets

PRIORT ART

PRIORT ART

SPRING CONNECTOR WITH SLOTTED CONDUCTIVE PIN

BACKGROUND OF THE INVENTION

The present invention relates to a spring connector.

FIG. 12 shows an example of the structure of a related-art spring connector. FIG. 12 is a longitudinal sectional view showing an example of the related-art spring connector. In FIG. 12, a coiled spring 12 is inserted in the cylindrical portion of a tube 10 formed of a conductive material which has the tip side to be an opened cylinder and the base end side to be a terminal having a small diameter, and furthermore, a pin 14 formed of a conductive material in which the tip side is stepped to have a small diameter is inserted therein and the open end of the tube 10 is caulked such that the pin 14 can be freely protruded and retracted while not being slipped out. The base end face of the pin 14 is a slant face. An assembly of the tube 10, the coiled spring 12 and the pin 14 is pressed and fixed into a holder 16 formed of an insulating resin from the tip side of the holder 16. The tube 10 and the pin 14 are plated with gold to be a good conductive material.

Moreover, FIG. 13 shows another example of the structure of the related-art spring connector. FIG. 13 is a longitudinal sectional view showing an example of the related-art spring connector of a right angle type. In FIG. 13, a coiled spring 12 and a pin 14 are inserted in the cylindrical portion of a tube 10 and an opening end is caulked so that the pin 14 can be freely protruded and retracted while not being slipped out in the same manner as in the example of FIG. 12. There is a difference in that a bulged portion is formed on the base end side of the tube 10 and the tube 10 is pressed into a holder 16 from the base end side so that the bulged portion and the base end face of the holder 16 are caused to interpose a terminal 18 therebetween. Furthermore, the side face of the holder 16 is formed to abut on a substrate 20 and the terminal 18 is properly bent along the substrate 20 and can be electrically connected to the wiring terminal of the substrate 20 by soldering.

Also in both of the spring connectors shown in FIGS. 12 and 13, the pin 14 abuts on the inner peripheral face of the cylindrical portion of the tube 10 to form a conductive circuit. In order to reduce an electric resistance caused by the abutment, the pin 14 and the tube 10 are plated with gold. However, the inner cylindrical portion of the tube 10 is a blind hole having one end opened, and a plating solution and a cleaning solution neither sufficiently flow into and out of the inner part of the hole so that plating failures are apt to be caused. Consequently, there is a drawback that conducting failures are apt to be caused. Moreover, there is a drawback that the tube 10 is formed by cutting, resulting in an increase in a manufacturing cost. In the right angle type shown in FIG. 13, furthermore, the terminal 18 is added to be a part so that the manufacturing cost is increased correspondingly. In addition, there is a possibility that the resistance of a whole conductive path might be increased due to electrical conduction caused by the contact of the tube 10 with the terminal 18.

SUMMARY OF THE INVENTION

It is therefore an object of the present invention to provide a spring connector provided with high reliability and can be manufactured inexpensively.

In order to achieve the above object, according to the present invention, there is provided a spring connector, comprising:

an insulating holder, having a first face and a second face, the insulating holder formed with a first hole having a first diameter at the first face, and a second hole having a second diameter larger than the first diameter and extended from the second face so as to communicate with the first hole;

a plate-shaped conductive terminal, having a base portion, at least one pair of guide portions extended from the base portion so as to define a concave portion therebetween, the terminal fitted into the second hole such that the concave portion faces the first hole;

a conductive pin, including a plunger portion having a diameter smaller than the second diameter and a base portion having a diameter substantially identical with the second diameter, the base portion of the pin being fitted with the guide portions so as to be slidable along the concave portion; and a spring member, provided in the concave portion so as to urge the pin toward the first face of the holder, so that the plunger portion of the pin is retractably protruded from the first face of the holder through the first hole.

In this configuration, since the plate-shaped terminal which can be manufactured by the pressing is used in place of the tube manufactured by cutting as described with reference the related-art art, manufacture can be carried out inexpensively.

In a case where a plurality of concave portions are formed in a single terminal, a plurality of conductive pins are provided to constitute a spring connector having a large number of contacts. Therefore, the manufacture can be carried out more inexpensively as compared with the related-art case in which a plurality of spring connectors are arranged.

Preferably, the terminal and the pin are plated with gold.

Even in this configuration, a plating solution and a cleaning solution can easily flow into and out of a portion in which the pin and the terminal slidably fitted with each other. Consequently, plating can easily be carried out so that the reliability of an electrical connection can be enhanced.

Preferably, a tongue piece portion is extended from the base portion of the terminal so as to be protruded from the second face of the holder.

This configuration is suitable for a spring connector in which a terminal is inserted in a hole provided on a substrate and is electrically connected to a circuit provided on the back surface of a substrate by soldering.

Here, it is preferable that a side face which is other than the first face and the second face of the holder faces a substrate on which a circuit is provided. The tongue piece portion is so bent as to extend along the substrate.

This configuration is suitable for a spring connector in which a terminal is electrically connected to a circuit provided on an obviate surface of a substrate, on which the holder is placed, by soldering.

Here, it is preferable that the tongue piece portion is so bent as to extend toward the first face of the holder. The holder is formed with a recess to which a tip end of the tongue piece portion is inserted so as to prevent the tongue piece portion from deforming in a direction that the holder is away from the substrate according to a retracting movement of the pin.

In this configuration, the tongue piece portion can be provided in the installation area of the holder so that a mounting area can be reduced correspondingly. Moreover, the tip portion of the tongue piece portion is engaged with the recess of the holder. Therefore, as long as the tongue piece portion is fixed to the surface of the substrate, the holder is not separated from the substrate.

Alternatively, the tongue piece portion is so bent as to elastically contact with the substrate.

This configuration is suitable for a spring connector in which a terminal is elastically come in contact with a circuit provided on the obviate surface of the substrate, thereby carrying out an electrical connection of the terminal. Consequently, it is possible to omit a connecting work by soldering.

Preferably, the first face and the second face of the holder extend in a first direction. The second hole obliquely extends with respect to a second direction perpendicular to the first direction.

In this configuration, when the plunger portion of the pin is abutted on an inspected pad and furthermore they are approached with each other, a rubbing operation is carried out between the plunger portion and the inspected pad so that reliable conduction therebetween can be attained. In addition, the force for pressing the pin against the terminal is applied so that the conductivity can be enhanced.

In order to attain the above advantage, according to the present invention, there is also provided a conductivity inspection method, comprising the steps of:

providing the spring connector as set forth in claim 1;

providing a conductive pad on which the plunger portion of the spring connector is abutted to inspect that the conductive pad and the spring connector is electrically connected; and determining an extending direction of the second hole of the holder so as to be oblique with respect to a direction in which the conductive pad extends.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

A spring connector according to a first embodiment of the invention will be described below with reference to FIGS. 1–7.

Figure 1A:
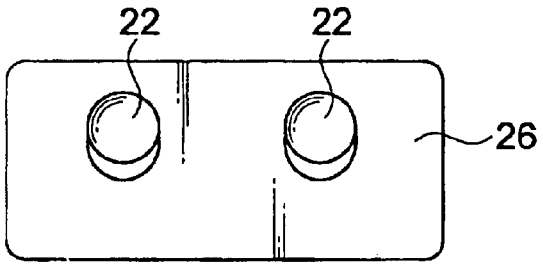
FIG. 1A is a plan view showing a spring connector according to a first embodiment of the invention.
Figure 1B:
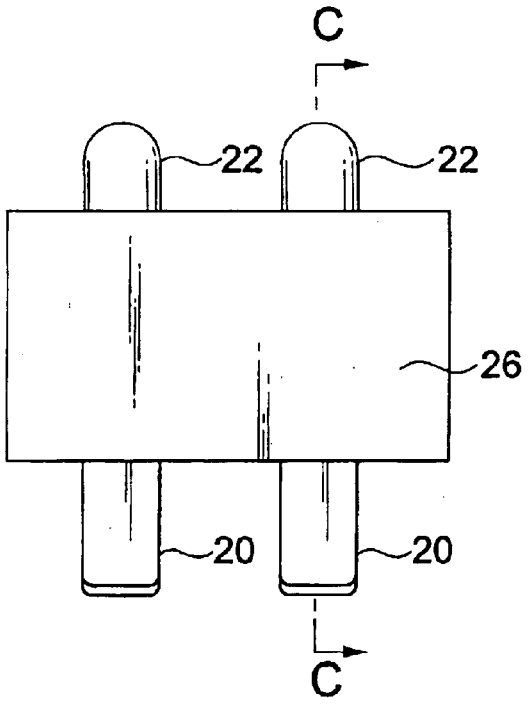
FIG. 1B is a front view showing the spring connector of the first embodiment.
Figure 1C:
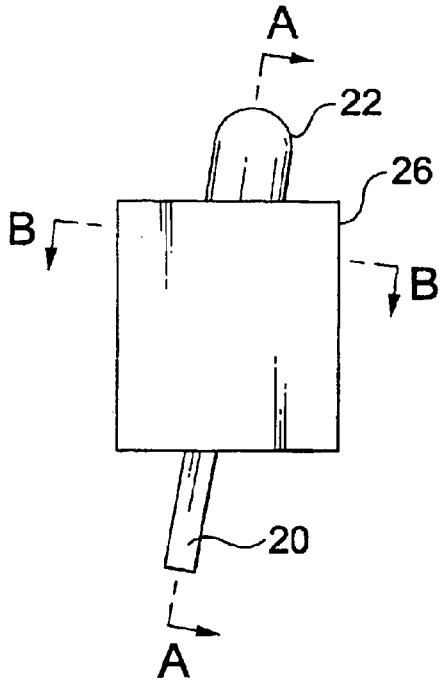
FIG. 1C is a side view showing the spring connector of the first embodiment.

As shown in FIGS. 1A to 1C, the spring connector is constituted by a conductive plate-shaped terminal 20, a conductive pin 22 which is slidable with respect to the terminal 20, a coiled spring 24 provided in a contraction state between the terminal 20 and the conductive pin 22, and a holder 26 formed of an insulating resin.

Figure 5A:
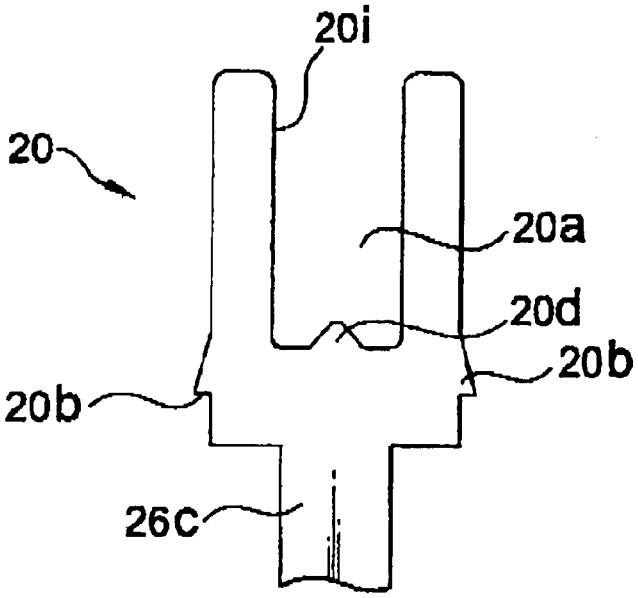
FIG. 5A is a front view showing a terminal incorporated in the spring connector.
Figure 5B:
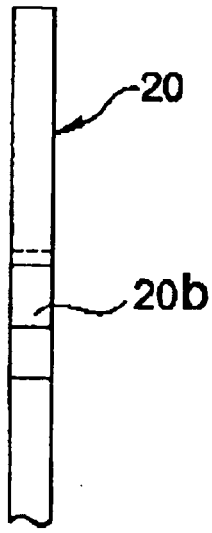
FIG. 5B is a side view showing the terminal.

As shown in FIGS. 5A and 5B, the terminal 20 is conductive and plate-shaped and has a tip portion provided with a concave portion 20*a* which is opened in the direction of the tip and which is provided with engagement projections 20*b* at side portions thereof, and a base end side is narrowed to form a tongue piece portion 20*c*. In other words, the terminal 20 is formed like a fork by pressing. A small projection 20*d* is formed on the bottom edge of the concave portion 20*a*. Furthermore, the surface of the terminal 20 is plated with gold to be a good conductive material.

Figure 6A:
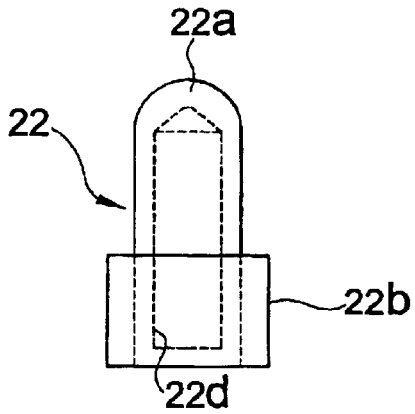
FIG. 6A is a front view showing a conductive pin incorporated in the spring connector.
Figure 6B:
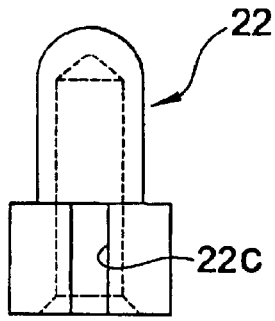
FIG. 6B is a side view showing the conductive pin.
Figure 6C:
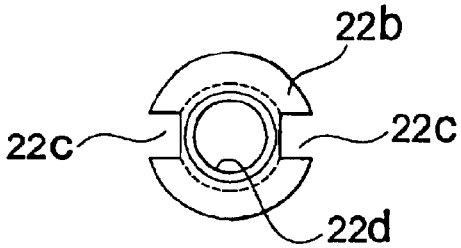
FIG. 6C is a bottom view showing the conductive pin.

As shown in FIGS. 6A to 6C, in the conductive pin 22, moreover, a plunger portion 22*a* having a small diameter is formed on the tip side, a bulged portion 22*b* having a large diameter is formed on the base end side and grooves 22*c* are formed on both sides of the bulged portion 22*b*. The grooves 22*c* are fitted in opposed inner edges 20*i* of the concave portion 20*a* of the terminal 20 and the conductive pin 22 is slidably provided on the terminal 20 by using the grooves 22*c* as guides. Furthermore, a bottomed hole 22*d* is extended from a base end face in an axial direction thereof. While the shape of the tip of the plunger portion 22*a* is hemispherical in the embodiment, it is a matter of course that a proper shape can be applied depending on an abutted terminal. Moreover, the outer peripheral face of the conductive pin 22 is wholly plated with gold.

Figure 2:
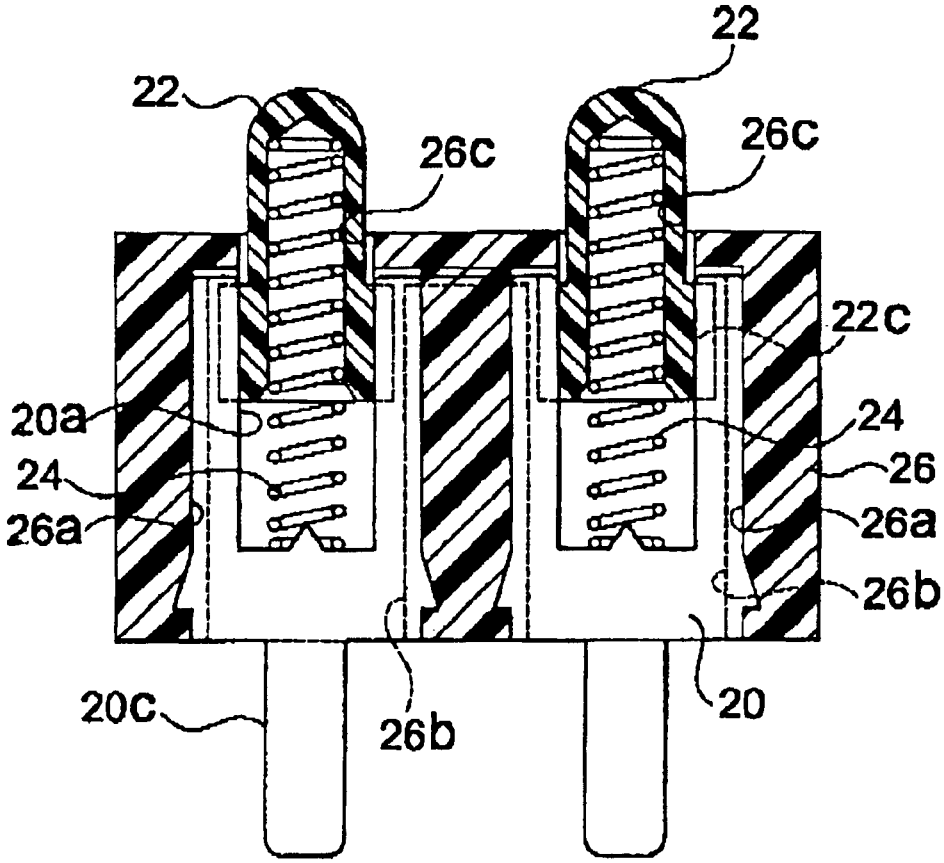
FIG. 2 is a sectional view taken along with a line A—A of FIG. 1C.
Figure 3:
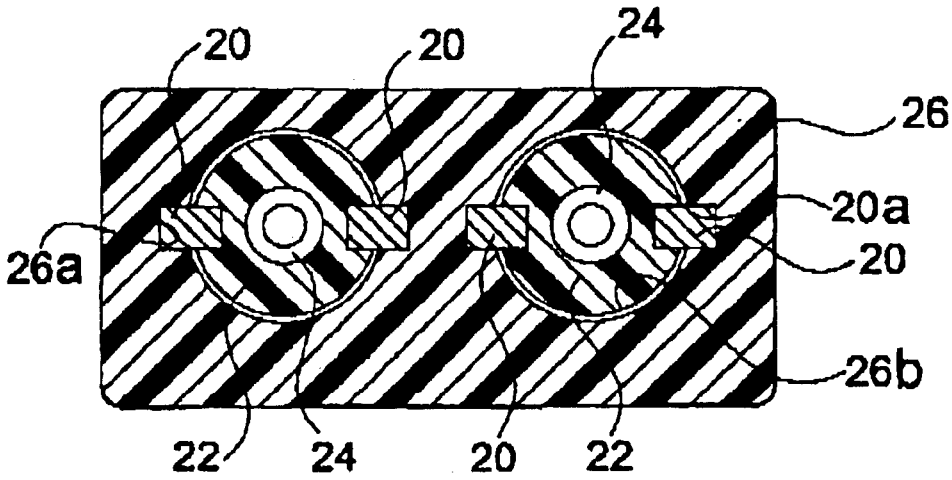
FIG. 3 is a sectional view taken along with a line B—B of FIG. 1C.
Figure 4:
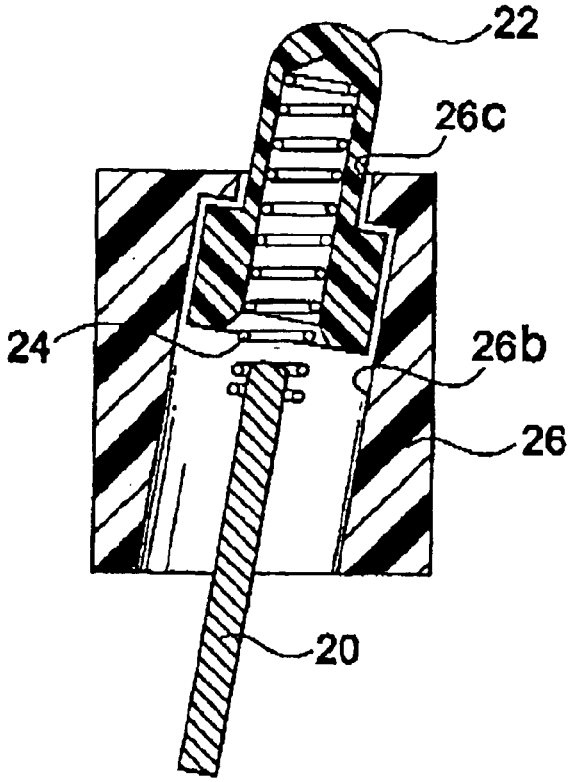
FIG. 4 is a sectional view taken along a line C—C of FIG. 1B.

As shown in FIGS. 2 to 4, the holder 26 is formed of an insulating resin such that a hole 26*b* having a large diameter corresponding to the bulged portion 22*b* extends obliquely therein. Grooves 26*a* are formed on both side inner faces of the hole 26*e* 26*b*. A hole 26*c* has a diameter smaller than the diameter of the bulged portion 22*b*. The terminal 20 on which the conductive Pin 22 is attached is inserted into the hole 26*b* from the base end side while the engagement projections 20*b* are engaged with the grooves 26*a* so that the terminal 20 is prevented from being slipped off the holder 26. In this state, the conductive pin 20 is slidable inside holder 26 along the inner edge 20*i* of the terminal 20 and the hole 26*b*.

A work for assembling the components will be described below. First of all, one end side of the coiled spring 24 is inserted in the bottomed hole 22*d* of the conductive pin 22 and the other end of the coiled spring 24 is caused to face the projection 20*d* on the bottom edge of the concave portion 20*a* of the terminal 20 to engage the grooves 22*c* with the opposed inner edges 20*i* of the concave portion 20*a* so that the conductive pin 22 is slidable on the terminal 20, but is stopped by the hole 26*c*.

The assembly is inserted from the base end side of the holder 26 with the terminal 20 engaged with the grooves 26*a* such that the slip-out can be prevented by the engagement projections 20*b* of the terminal 20. Consequently, the tongue piece portion 20*c* of the terminal 20 is protruded from the base end face of the holder 26 and the tip portion of the plunger portion 22*a* of the conductive pin 22 is protruded from the tip end face of the holder 26. The plunger portion 22*a* is elastically urged toward the tip end side by the coiled spring 24 so that the protrusion and retraction can be carried out freely.

The operation of the spring connector will be described with reference to FIG. 7. The base end face of the holder 26 is provided in abutment on a substrate 30 and the tongue piece portion 20*c* of the terminal 20 is properly connected electrically to the circuit formed on the substrate 30 by soldering. The direction of the protrusion and retraction of the plunger portion 22*a* is set obliquely with respect to the side faces of the holder 26. Moreover, an inspected member 32 is provided opposite to the substrate 30 and an abutted terminal 32*a* is provided on the inspected member 32 opposite to the plunger 22*a*.

When the substrate 30 and the inspected member 32 are approached, the plunger portion 22*a* first abuts on a T1 position of the abutted terminal 32*a* and is then moved to a T2 position by further approaching movement and is thus shifted by a dimension of d due to the above mentioned oblique configuration. By the shift of d, the abutted terminal 32*a* and the abutting portion of the plunger portion 22*a* are rubbed with each other so that an electrical connection can be obtained more reliably.

Moreover, a reaction force F in an oblique direction applied to the conductive pin 22 by the coiled spring 24 and a force P causing the substrate 30 and the inspected member 32 to approach generates a force F1. The force F1 acts to press the inner walls of the grooves 22*c* of the bulged portion 22*b* of the conductive pin 22 against the inner edge 20*i* of the concave portion 20*a* of the terminal 20. Consequently, the electrical connection of the conductive pin 22 and the terminal 20 can be enhanced reliably.

In the spring connector according to the invention, furthermore, the terminal 20 formed of a plate metal is used in place of the related-art tube 10 using a cutting process. Hence, manufacture can be carried out by inexpensive pressing so that a manufacturing cost can be reduced correspondingly.

Moreover, while both of the terminal 20 and the conductive pin 22 are plated with gold, the tip portion of the plunger portion 22*a* to abut on the abutted terminal 32*a*, the inner edge 20*i* of the concave portion 20*a* in which the terminal 20 and the conductive pin 22 slidably come in contact with each other, and the inner walls of the grooves 22*c* of the bulged portion 22*b* have such shapes that a plating solution and a cleaning solution can flow in and out easily and reliably. Therefore, gold plating can be carried out reliably so that the reliability of the electrical connection can be enhanced correspondingly. This method is more reliable than the gold plating to be carried out over the cylindrical inner peripheral wall of the blind hole of the related-art tube 10.

Next, a spring connector according to a second embodiment of the invention, which is the right angle type, will be described with reference to FIG. 8. The side face of a holder 26 is abutted on a substrate 30 and fixed thereon, and the direction of the protrusion and retraction of a plunger portion 22*a* is set to be an oblique transverse direction with respect to the substrate 30. A tongue piece portion 20*e* of a terminal 20 protruded from the base end side of the holder 26 is so bent as to extend along the substrate 30.

In the second embodiment having such a structure, the tongue piece portion 20*e* of the terminal 20 can be electrically connected to a circuit provided on the surface of the substrate 30 by soldering and can be fixed. Also in the right angle type, the number of parts can be prevented from being increased and manufacture can be carried out inexpensively.

Furthermore, a third embodiment of the invention will be described with reference to FIG. 9. This embodiment is different from the second embodiment in that a tongue piece portion 20*f* of a terminal 20 is so bent as to take the shape of a spring which elastically comes in contact with a circuit formed on the surface of a substrate 30.

In the third embodiment having such a structure, the side face of a holder 26 is abutted on the substrate 30 and fixed thereon. Consequently, the tongue piece portion 20*f* elastically comes in contact with the circuit provided on the surface of the substrate 30 so that an electrical connection is obtained. A time and labor for a circuit connection can be omitted, which is suitable for the mass production of an apparatus in which a large number of spring connectors are provided in the substrate 30.

Moreover, a fourth embodiment of the invention will be described with reference to FIG. 10. In the same manner as in the second embodiment shown in FIG. 8, this embodiment provides a right angle type in which the side face of a holder 26 is abutted on a substrate 30 and fixed thereon. The direction of protrusion and retraction of a plunger portion 22*a* is set to be an obliquely transverse direction with respect to the substrate 30. A tongue piece portion 20*g* of a terminal 20 protruded from the base end side of the holder 26 is bent toward a tip end side at which the plunger portion 22*a* of a conductive pin 22 is protruded and is extended along the substrate 30. An erected portion 20*h* is provided in the tip portion of the tongue piece portion 20*g*. The holder 26 is also provided with a concave portion 26*d* where the erected portion 20*h* is inserted and engaged. It is sufficient that the tip portion of the tongue piece portion 20*g* is engaged with the concave portion 26*d* of the holder 26 and the erected portion 20*h* does not need to be always formed.

In the fourth embodiment having such a structure, the tongue piece portion 20*g* of the terminal 20 can be electrically connected to a circuit provided on the surface of the substrate 30 by soldering in the same manner as in the second embodiment and can be fixed. The tongue piece portion 20*g* can be provided in the installation area of the holder 26 so that a mounting area can be reduced correspondingly. The force for pressing the plunger portion 22*a* in the direction of retraction elastically deforms the bent portion of the tongue piece portion 20*g* in an expansion direction and acts to separate the holder 26 from the substrate 30. However, the erected portion 20*h* in the tip portion of the tongue piece portion 20*g* is engaged with the concave portion 26*d* of the holder 26. Therefore, as long as the tongue piece portion 20*g* is fixed to the surface of the substrate 30, the holder 26 is not separated from the substrate 30.

Figure 11:
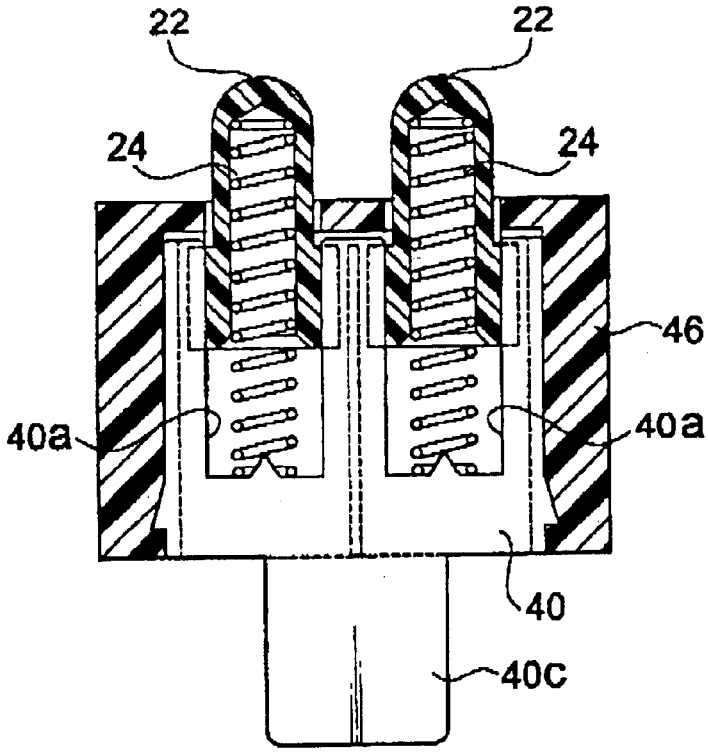
FIG. 11 is a sectional front view showing a spring connector according to a fifth embodiment of the invention.
Figure 12:
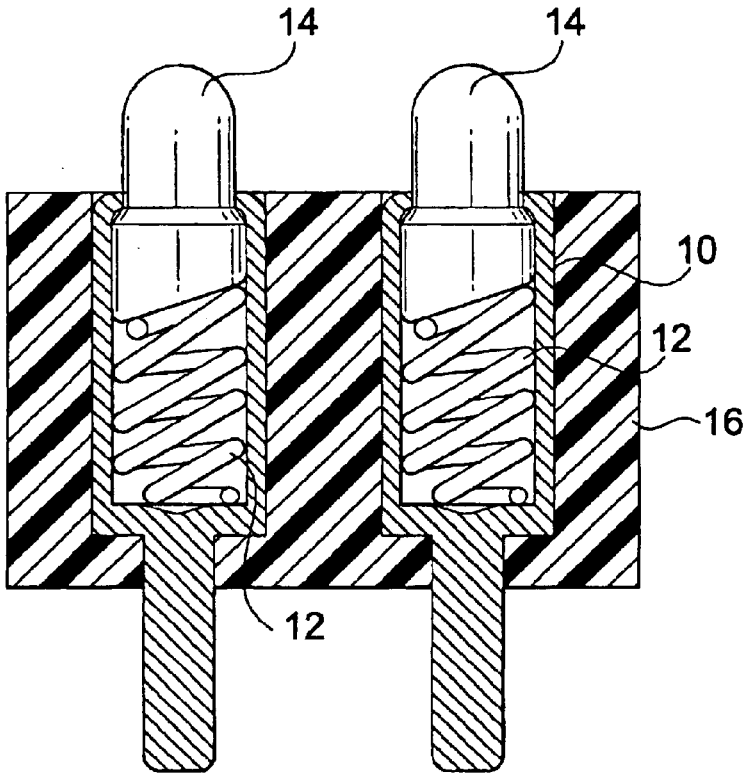
FIG. 12 is a sectional front view showing a first related-art spring connector.
Figure 13:
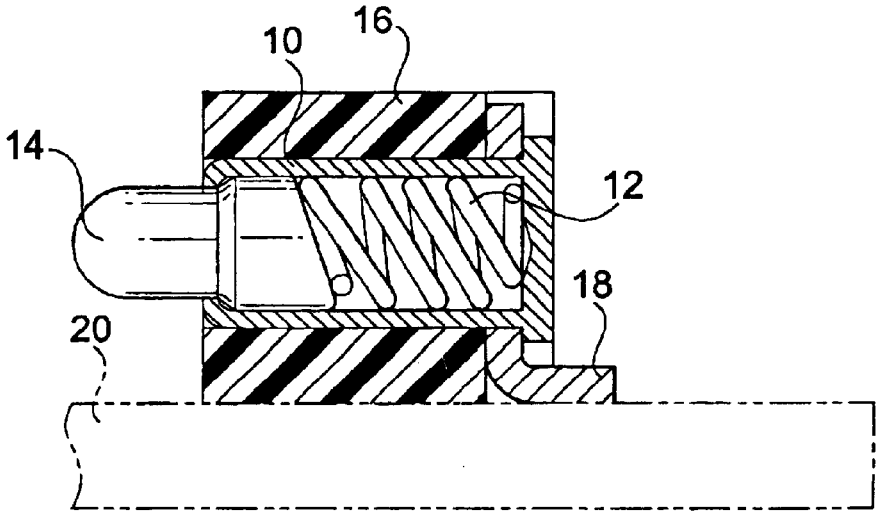
FIG. 13 is a sectional side view showing an example of a second related-art spring connector.

Furthermore, a fifth embodiment of the invention will be described with reference to FIG. 11. In this embodiment, two concave portions 40*a* opened in the direction of a tip end side are formed in a conductive plate-shaped terminal 40 and a single tongue piece portion 40*c* is formed on the base end side. A coiled spring 24 and a conductive pin 22 are assembled into the two concave portions 40*a* of the terminal 40 in the same manner as in the first embodiment. Furthermore, a holder 46 formed of an insulating resin is formed such that the terminal 40 and the two conductive pins 22 assembled therein are properly inserted and fixed in the same manner as in the first embodiment.

In the fifth embodiment having such a structure, the two conductive pins 22 are individually urged elastically in the direction of protrusion through the coiled springs 24 and plunger portions 22*a* protruded from the holder 46 can be individually protruded and retracted freely. Since the electrical connection is carried out on two contacts with respect to an abutted terminal 32*a*, this spring connector can be provided with higher reliability. In addition, the number of parts can be wholly decreased and manufacture can be correspondingly carried out inexpensively as compared with the related-art structure in which two spring connectors are arranged. While the two contacts are employed for the abutted terminal 32*a* in this embodiment, it is a matter of course that three or more contacts may be provided.

In the embodiments, the description has been given to the structure in which the direction of the protrusion and retraction of the conductive pin 22 is set to be oblique with respect to the substrate 30 while the substrate 30 and the inspected member 32 provided in parallel with each other are vertically approached to each other. However, the direction of the protrusion and retraction of the conductive pin 22 may be set to be a vertical direction with respect to the substrate 30 if the substrate 30 and the inspected member 32 provided in parallel with each other are approached obliquely with respect to the protruding and retracting direction of the conductive pin 22. In this case, it is also possible to obtain the rubbing operation of the plunger portion 22*a* and the abutted terminal 32*a* so that the reliable electrical connection of the conductive pin 22 and a terminal 20 can be attained.

Moreover, if one spring connector can be provided on the substrate 30 or the spring connectors can be arranged in a line on the substrate 30, the direction of the protrusion and retraction of the conductive pin 22 may be set to be a vertical direction with respect to the substrate 30 while the inspected member 32 is provided obliquely with respect to the substrate 30. In this case, it is also obtain the above explained rubbing operation.

Furthermore, if the opposed inner edges 20*i* of the concave portion 20*a* of the terminal 20 are properly bent to serve as elastic contact pieces so as to always elastically come in contact with the inner walls of the grooves 22*c* on both sides of the bulged portion 22*b* of the conductive pin 22, the conductive pin 22 and the terminal 20 can obtain a reliable electrical connection even if the force F1 for urging the conductive pin 22 toward the inner face of the hole 26*b* is not applied.

With such a structure that they act as the elastic contact pieces, the rubbing operation between the plunger portion 22*a* and the abutted 32*a* cannot be obtained, however, the electrical connection of the terminal 20 and the conductive pin 22 can be reliably obtained even if the direction of the protrusion and retraction of the conductive pin 22 is set to be vertical with respect to the substrate 30 while the substrate 30 and the inspected member 32 provided in parallel with each other are approached to each other.

Furthermore, while the description has been given such that the holder 26 is provided and fixed to the substrate 30 in the embodiments, a part of the housing of an apparatus may be formed to serve as a holder and the substrate 30 may be provided in such a housing.

Figure 7:
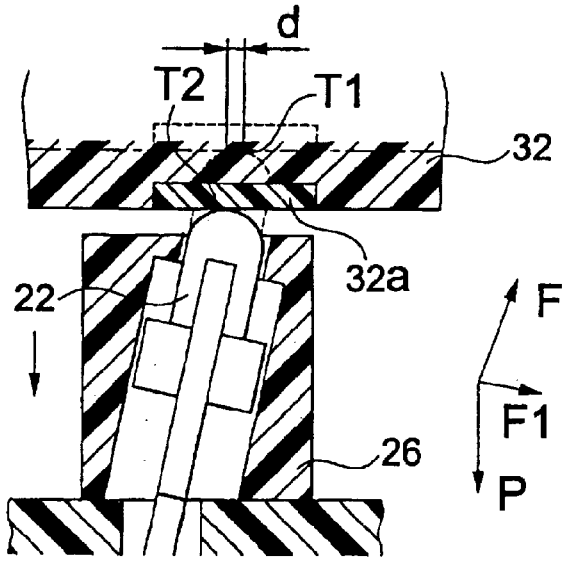
FIG. 7 is a diagram for explaining the function of the protrusion and retraction of the conductive pin set in an oblique direction.
Figure 8:
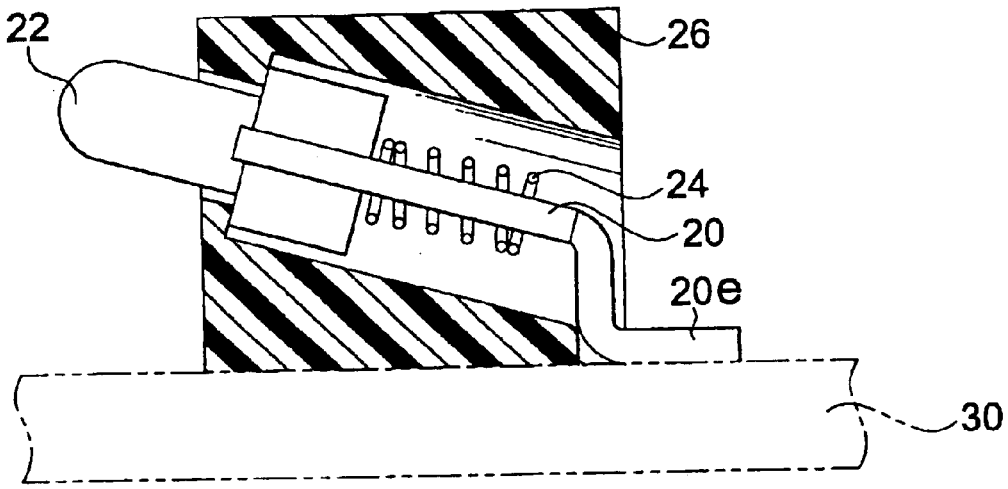
FIG. 8 is a sectional side view showing a spring connector according to a second embodiment of the invention.
Figure 9:
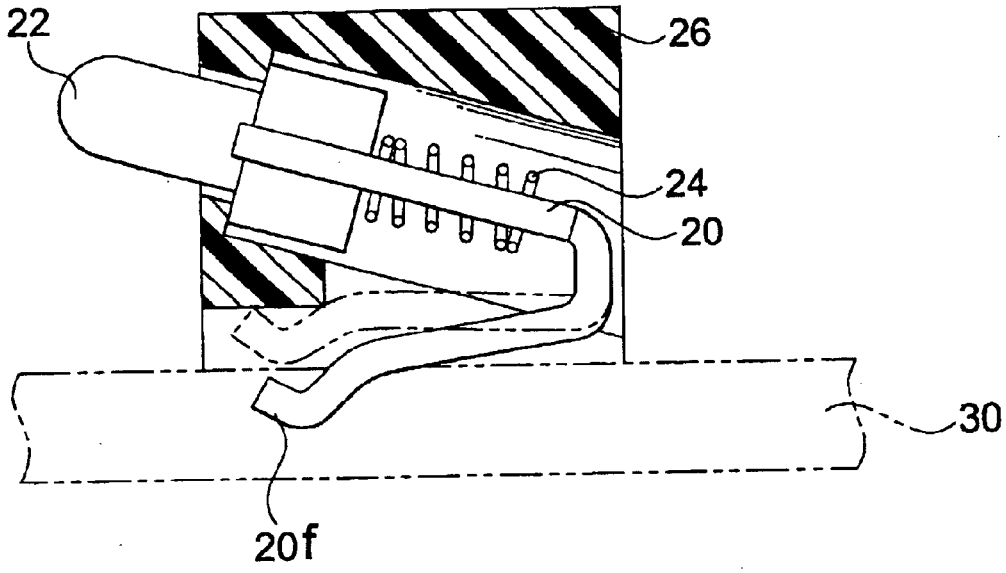
FIG. 9 is a sectional side view showing a spring connector according to a third embodiment of the invention.
Figure 10:
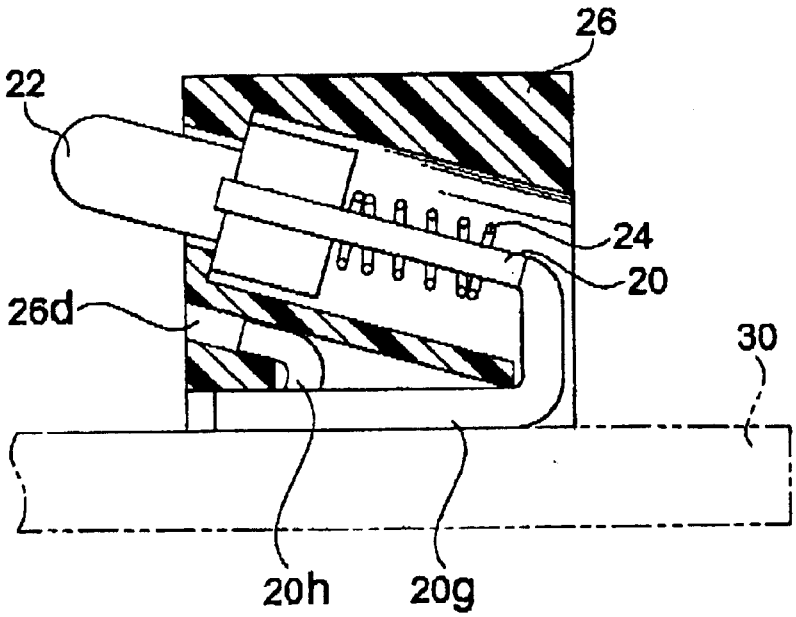
FIG. 10 is a sectional side view showing a spring connector according to a fourth embodiment of the invention.

Moreover, while FIG. 7 shows that the tongue piece portion 20*c* of the terminal 20 is inserted through a hole provided on the substrate 30 in the first embodiment, the tongue piece portion may be electrically connected to the circuit provided on the surface of the substrate 30 as in the second embodiment shown in FIG. 8, the third embodiment shown in FIG. 9 and the fourth embodiment shown in FIG. 10. Also in the right angle type shown in FIGS. 8 to 10, it is a matter of course that the tongue piece portion of the terminal 20 may be formed to be inserted through the hole provided on the substrate 30.

What is claimed is:

1. A spring connector, comprising:

an insulating holder, having a first face and a second face, the insulating holder formed with a first hole having a first diameter at the first face, and a second hole having a second diameter larger than the first diameter and extended from the second face so as to communicate with the first hole;

a plate-shaped conductive terminal, having a base portion, at least one pair of guide portions extended from the base portion so as to define a concave portion between opposed inner edges of the guide portions, the terminal fitted into the second hole such that the concave portion faces the first hole;

a conductive pin, including a plunger portion having a diameter smaller than the first diameter and a bulged portion having a diameter larger than the first diameter, the bulged portion of the pin having opposed grooves at its periphery that run parallel to a longitudinal axis of the plunger portion and are fitted with the opposed inner edges of the guide portions so as to be slidable along the concave portion; and a spring member, provided in the concave portion so as to urge the pin toward the first face of the holder, so that the plunger portion of the pin is retractably protruded from the first face of the holder through the first hole.

2. The spring connector as set forth in claim 1, wherein the terminal and the pin are plated with gold.

3. The spring connector as set forth in claim 1, wherein the first face and the second face of the holder extend in a first direction; and wherein the second hole obliquely extends with respect to a second direction perpendicular to the first direction.

4. The spring connector as set forth in claim 1, wherein a tongue piece portion is extended from the base portion of the terminal so as to be protruded from the second face of the holder.

5. The spring connector as set forth in claim 4, wherein a side face which is other than the first face and the second face of the holder faces a substrate on which a circuit is provided; and wherein the tongue piece portion is so bent as to extend along the substrate.

6. The spring connector as set forth in claim 4, wherein a side face which is other than the first face and the second face of the holder faces a substrate on which a circuit is provided; and wherein the tongue piece portion is so bent as to elastically contact with the substrate.

7. The spring connector as set forth in claim 5, wherein the tongue piece portion is so bent as to extend toward the first face of the holder; and wherein the holder is formed with a recess to which a tip end of the tongue piece portion is inserted so as to prevent the tongue piece portion from deforming in a direction that the holder is away from the substrate according to a retracting movement of the pin.

8. A conductivity inspection method, comprising the steps of:

providing the spring connector as set forth in claim 1;

providing a conductive pad on which the plunger portion of the spring connector is abutted so that the electrical continuity of the conductive pad and the spring connector may be tested; and determining that the second hole extends into the holder at an oblique angle with respect to a normal line of the conductive pad.

* * * * *